US006230923B1

(12) United States Patent
Hung

(10) Patent No.: US 6,230,923 B1
(45) Date of Patent: May 15, 2001

(54) DRINKING BOTTLE PROVIDED WITH A FLEXIBLE LIQUID-SUCKING MEMBER ADAPTED TO SERVE AS A DRINKING STRAW

(75) Inventor: Kung-Tie Hung, Changhua Hsien (TW)

(73) Assignee: Lineo Baby Merchandise Work's Co., Ltd., Changhua Hsien (TW)

( * ) Notice: Subject to any disclaimer, the term of this patent is extended or adjusted under 35 U.S.C. 154(b) by 0 days.

(21) Appl. No.: 09/653,438

(22) Filed: Sep. 1, 2000

(51) Int. Cl.[7] ..... A47G 19/22

(52) U.S. Cl. ..... 220/703; 220/711; 220/714; 220/717

(58) Field of Search ..... 220/703, 705, 220/709, 711, 714, 717

(56) References Cited

U.S. PATENT DOCUMENTS 2,608,841 * 9/1952 Rice ..... 220/717 X
4,946,062 * 8/1990 Coy et al. ..... 220/714
5,105,976 * 4/1992 Patterson ..... 220/703 X
5,542,670 * 8/1996 Morano ..... 220/711 X
5,702,025 * 12/1997 Di Gregorio ..... 220/717
5,706,973 * 1/1998 Robbins, III et al. ..... 220/714
5,890,619 * 4/1999 Belanger ..... 220/714 X
5,890,620 * 4/1999 Belcastro ..... 220/714
5,988,425 * 11/1999 Yehl et al. ..... 220/717 X
6,050,445 * 4/2000 Manganiello ..... 220/717 X
6,102,245 * 8/2000 Haberman ..... 220/714

* cited by examiner

*Primary Examiner*—Steven Pollard
(74) *Attorney, Agent, or Firm*—Trop, Pruner & Hu, P.C.

(57) ABSTRACT

A drinking bottle includes a bottle body, a cap mounted threadably on an upper end portion of the bottle body, and a flexible liquid-sucking member that has a horizontal disk clamped between the upper end portion of the bottle body and an annular plate of the cap in such a manner that a liquid-tight seal is established between the cap and the liquid-sucking member and between the liquid-sucking member and the bottle body. The liquid-sucking member has a suction tube that is formed on a top surface of the disk and that extends through an eccentric hole formed in the annular plate of the cap, and a through hole that extends through the disk and the suction tube and that is in fluid communication with an upper end opening in the bottle body. The suction tube has a distal outer end portion that is provided with a liquid-controlling valve to permit outflow of liquid from the outer end portion when the latter is sucked. The suction tube has a peripheral flange that projects outwardly and radially from an outer surface thereof and that defines a plate-retention groove in cooperation with the disk for engaging the inner periphery which defines the eccentric hole in the annular plate of the cap.

5 Claims, 4 Drawing Sheets

DRINKING BOTTLE PROVIDED WITH A FLEXIBLE LIQUID-SUCKING MEMBER ADAPTED TO SERVE AS A DRINKING STRAW

BACKGROUND OF THE INVENTION

1. Field of the Invention

The present invention relates to a drinking bottle, more particularly to a drinking bottle provided with a flexible liquid-sucking member.

2. Description of the Related Art

Referring to FIG. 1, a conventional drinking bottle includes a bottle body 1' that defines a liquid-accommodating space therein and that has an externally threaded open upper end for access into the liquid-accommodating space, and an annular cap 1 that has an internally threaded lower portion for engaging threadably the upper end of the bottle body 1'.

The bottle body 1' and the cap 1 are made of a rigid material. The cap 1 includes an upwardly extending suction tube 101 which has an uppermost end portion formed with a liquid outlet 102, a vent hole 103, and a pair of inner tube portions 104,105 which extend downwardly from a bottom surface thereof and which are respectively aligned with and in communication with the liquid outlet 102 and the vent hole 103. A rubber seal ring 3 is clamped between the upper open end of the bottle body 1', and the bottom surface of the cap 1 so as to form an annular liquid-tight seal therebetween.

A valve member 2 includes two tube engaging portions 205 which are sleeved respectively on the inner tube portions 104,105 of the cap 1 and which are provided with a liquid-control valve 203 and a valve vent 204 at lower end portions thereof such that the liquid-control valve 203 and the valve vent 204 remain closed at a normal condition, i.e., when no suction force is applied on the liquid outlet 102 of the suction tube 101. When a suction force is applied to the liquid outlet 102 of the suction tube 101, the liquid-control valve 203 is opened such that the liquid flows out of the suction tube 101, and air flows into the bottle body 1' via the vent hole 103 and the vent valve 204.

Some of the drawbacks of the aforesaid conventional drinking bottle are as follows:

(i) Aligning the tube engaging portions 205 of the valve member 2 with the inner tube portions 104,105 of the cap 2 during assembly is somewhat difficult and time-consuming.

(ii) In case the cap 1 collides against the lips or gums of a user by accident, injuries can result since the cap 1 is made of a rigid material.

(iii) Some liquid can be trapped in the tube engaging portions 205 of the sleeve member 2, thereby preventing thorough cleaning of the conventional drinking bottle.

SUMMARY OF THE INVENTION

Therefore, the object of this invention is to provide a drinking bottle having a flexible liquid-sucking member of a specific structure such that the aforesaid drawbacks of the conventional drinking bottle can be avoided. The liquid-sucking member is fixed on a bottle body and a cap in such a manner that a liquid-tight seal is established thereamong. In addition, the liquid-sucking member can serve as a drinking straw such that children or patients can easily consume the liquid disposed in the bottle body without assistance while preventing spilling of the liquid when the bottle body is in an inclined or horizontal position.

Accordingly, the drinking bottle of the present invention includes a bottle body, an annular cap, and a unitary liquid-sucking member. The bottle body defines a liquid-accommodating space therein, and has an upper end opening for access into the liquid-accommodating space, and an externally threaded upper end portion. The cap has an internally threaded lower skirt portion that engages threadably the externally threaded upper end portion of the bottle body, and an annular plate which has an outer periphery that is formed integrally with an upper end of the internally threaded lower skirt portion, and an inner periphery which defines an eccentric hole that is offset from a center of the annular plate. The cap is formed with a vent hole. The liquid-sucking member is made of a flexible material, and has a horizontal disk that is clamped between the externally threaded upper end portion of the bottle body and the annular plate of the cap and that is disposed within the internally threaded lower skirt portion of the cap in such a manner that a liquid-tight seal is established between the cap and the liquid-sucking member and between the liquid-sucking member and the bottle body. The liquid-sucking member further has a suction tube that is formed on a top surface of the disk and that extends through the eccentric hole in the cap, and a through hole that extends through the disk and the suction tube and that is in fluid communication with the upper end opening in the bottle body. The suction tube has a distal outer end portion that is provided with a first liquid-controlling valve so as to be adapted to permit the outflow of liquid from the outer end portion when the outer end portion is sucked and so as to prevent outflow of the liquid from the outer end portion when no suction force is applied to the outer end portion. The suction tube has a proximate inner end portion which is formed with a peripheral flange that projects outwardly and radially from an outer surface thereof adjacent to the disk so as to define a peripheral plate-retention groove that is disposed between the flange and the disk. The inner periphery of the annular plate engages fittingly the plate-retention groove. The disk is formed with a valve hole which is in fluid communication with the vent hole in the cap and which is provided with a second liquid-controlling valve so as to close the valve hole, thereby preventing the outflow of the liquid from the bottle body therethrough when no suction force is applied to the outer end portion of the suction tube, and so as to open the valve hole, thereby permitting inflow of air into the bottle body when the outer end portion of the suction tube is sucked.

BRIEF DESCRIPTION OF THE DRAWINGS

Other features and advantages of this invention will become more apparent in the following detailed description of a preferred embodiment of this invention, with reference to the accompanying drawings, in which.

DETAILED DESCRIPTION OF THE PREFERRED EMBODIMENT

Figure 1:
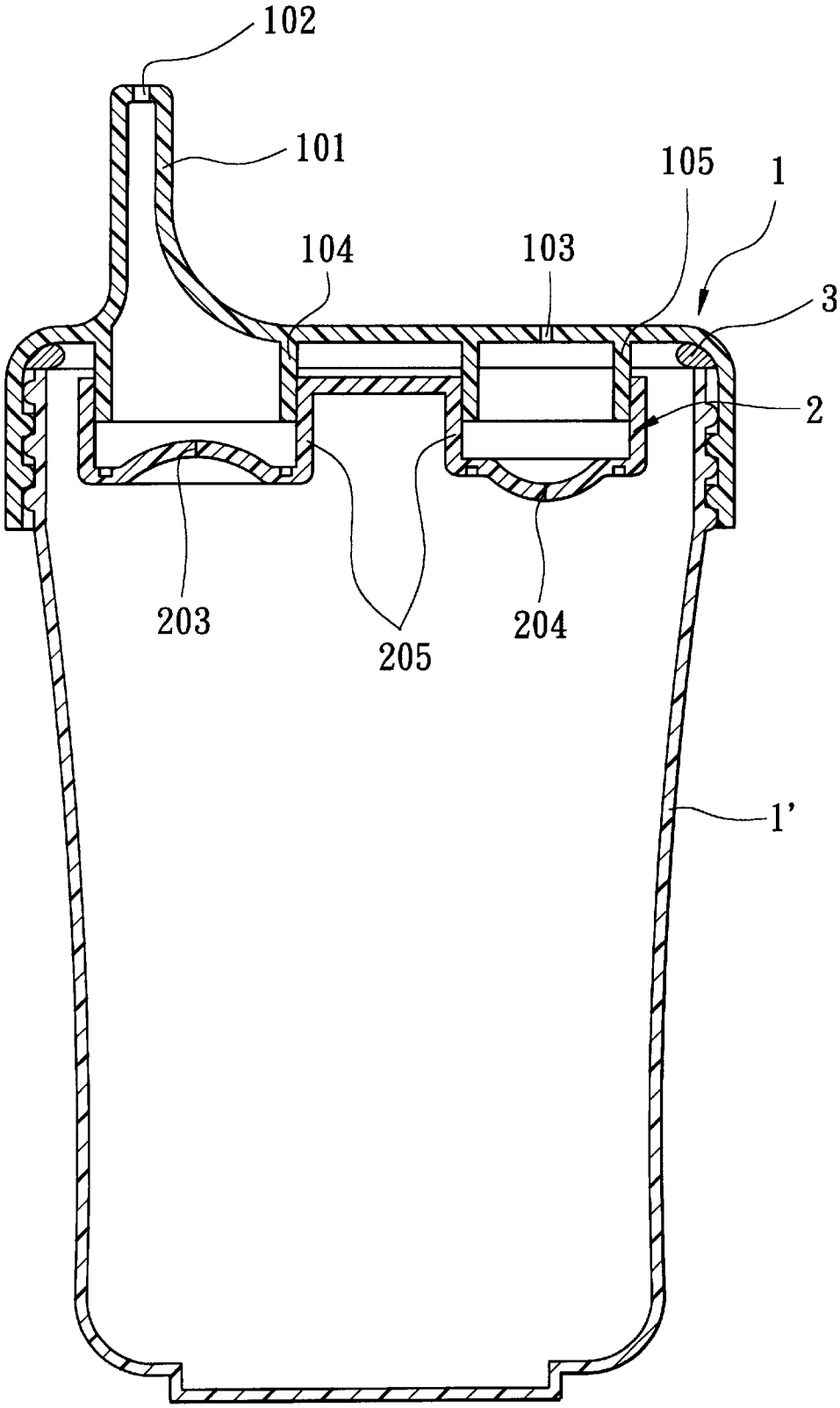
FIG. 1 PRIOR ART
FIG. 1 is a sectional side view of a conventional drinking bottle.
Figure 2:
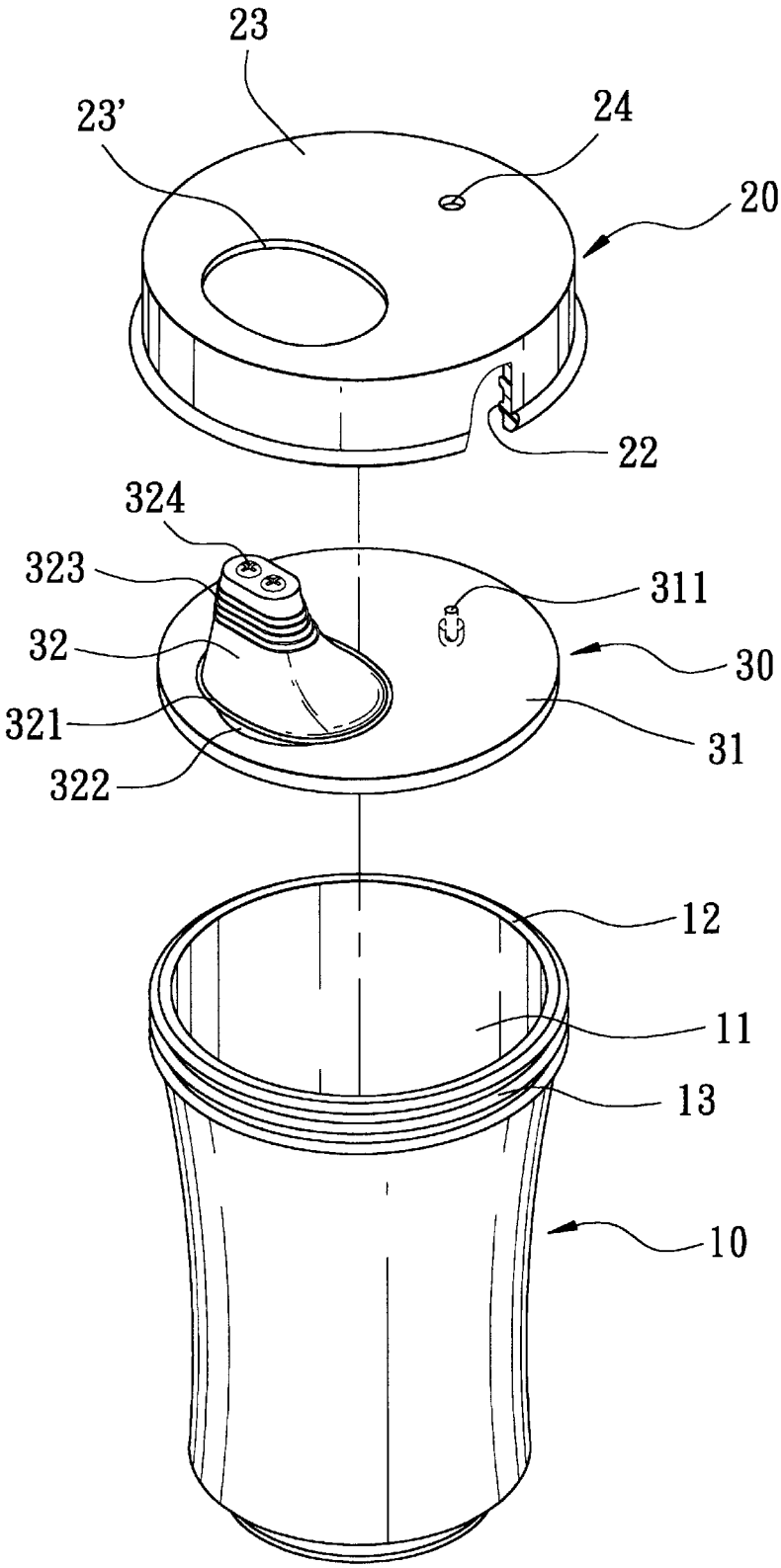
FIG. 2 is an exploded view of a preferred embodiment of a drinking bottle of the present invention.
Figure 3:
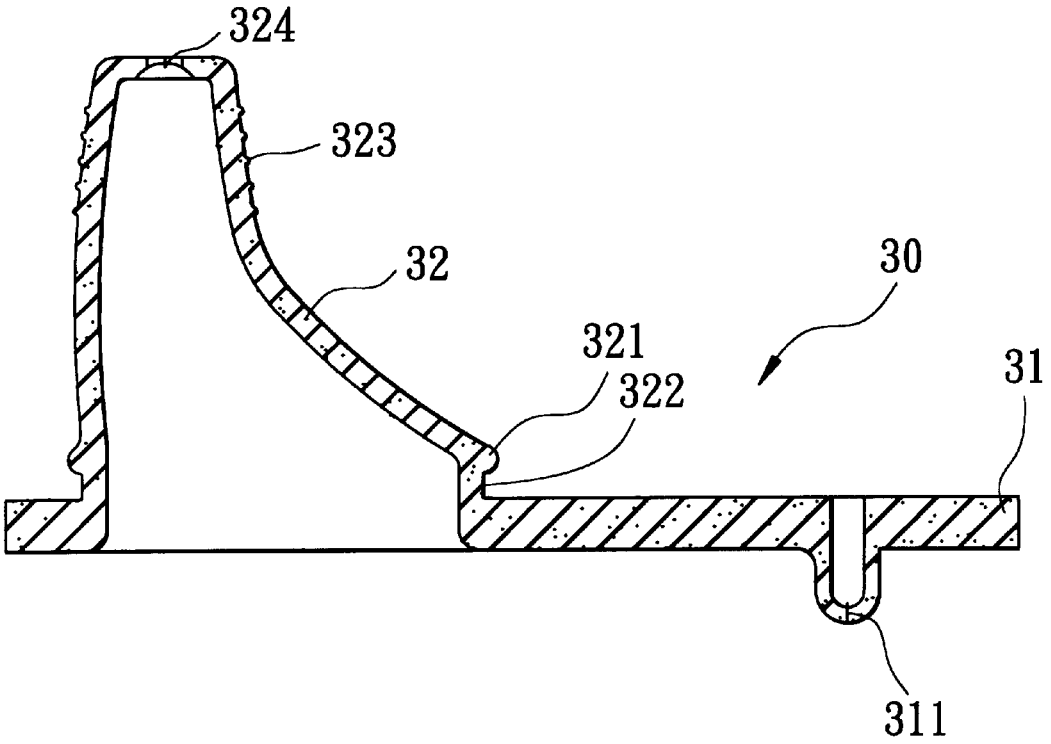
FIG. 3 is a sectional side view of a flexible liquid-sucking member employed in the preferred embodiment.
Figure 4:
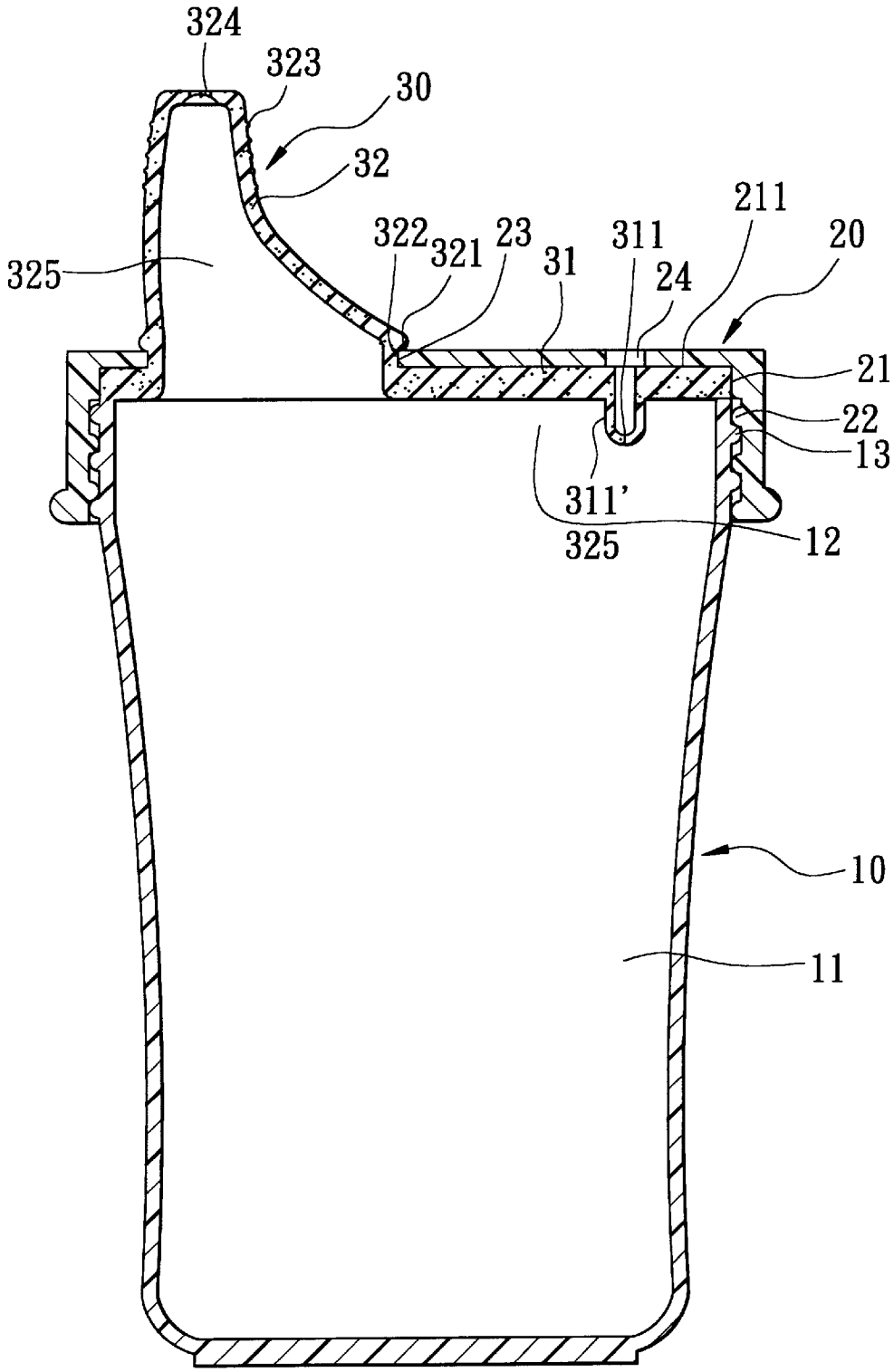
FIG. 4 is a sectional side view of the preferred embodiment.

Referring to FIGS. 2, 3 and 4, the preferred embodiment of a drinking bottle of the present invention is shown to include a bottle body 10, an annular cap 20, and a unitary liquid-sucking member As illustrated, the bottle body 10 defines a liquid-accommodating space 11 therein, and has an upper end opening 12 for access into the liquid-accommodating space 11, and an externally threaded upper end portion 13.

The cap 20 includes an internally threaded lower skirt portion 22 that engages threadably the threaded upper end portion 13 of the bottle body 10, and a horizontal annular plate 23 which has an outer periphery that is formed integrally with an upper end of the threaded lower skirt portion 22, and an inner periphery which defines an eccentric hole 23' that is offset from a center of the annular plate 23. The annular plate 23 of the cap 20 is further formed with a vent hole 24.

The liquid-sucking member 30 is made of a flexible material, such as a silicone rubber. The liquid-sucking member 30 has a horizontal disk 31 that is clamped between the threaded upper end portion 13 of the bottle body 10 and the annular plate 23 of the cap 20 and that is disposed within the internally threaded lower skirt portion 13 of the cap 20 in such a manner that a liquid-tight seal is established between the cap 20 and the liquid-sucking member 30 and between the liquid-sucking member 30 and the bottle body 10. The liquid-sucking member 30 further includes a suction tube 32 that is formed on a top surface of the disk 31 and that extends through the eccentric hole 23' in the cap 20, and a through hole 325 (see FIG. 4) that extends through the disk 31 and the suction tube 32 and that is in fluid communication with the upper end opening 12 in the bottle body 10. The suction tube 32 has a distal outer end portion that is provided with a first liquid-controlling valve 324 so as to be adapted to permit the outflow of liquid from the outer end portion when the outer end portion is sucked and so as to prevent outflow of the liquid from the outer end portion when no suction force is applied to the outer end portion. Preferably, the suction tube 32 has an upper end surface. The first liquid-controlling valve 324 includes two upper cross-shaped slit units which are formed in the upper end surface of the suction tube 32. The suction tube 32 further has a proximate inner end portion which is formed with a peripheral flange 321 that projects outwardly and radially from an outer surface thereof adjacent to the disk 31 so as to define a peripheral plate-retention groove 322 that is disposed between the flange 321 and the disk 31. The inner periphery of the annular plate 23 engages fittingly the plate-retention groove 322 in the suction tube 32. The disk 31 is formed with a valve hole 311 which is in fluid communication with the vent hole 24 in the cap 20 and which is provided with a second liquid-controlling valve so as to close the valve hole 311, thereby preventing the outflow of the liquid from the bottle body 10 therethrough when no suction force is applied to the outer end portion of the suction tube 32. When the outer end portion of the suction tube 32 is sucked, air flows into the bottle body 10 due to opening of the second liquid-controlling valve.

The suction tube 32 further includes a plurality of densely located peripheral rings 323 formed on the outer surface thereof proximate to the distal outer end portion. These peripheral rings 323 enhance frictional engagement with the gums of an infant or toothless patient, in case the drinking bottle of the present invention is used to feed the infant while the infant is at a teething age or when the patient is without teeth due to old age.

In this preferred embodiment, each of the inner end portion of the suction tube 32 and the eccentric hole 23' in the annular plate 23 is oval-shaped. The eccentric hole 23' in the annular plate 23 has a major diameter and a minor diameter slightly smaller than those of the inner end portion of the suction tube 32.

The second liquid-controlling valve on the disk 31 includes a hollow projection 311' which projects downward from the disk 31, and a lower slit unit which is formed in the projection 311' and which is in fluid communication with the vent hole 24 in the cap 20 and the liquid-accommodating space 11 in the bottle body 10.

Since a liquid-tight seal is established between the cap 20 and the liquid-sucking member 30 and between the liquid-sucking member 30 and the bottle body 10, no liquid is spilled from the bottle body 10 in case the bottle body 10 is in an inclined or horizontal position. In addition, the liquid-sucking member 30 can serve as a drinking straw such that children or bed-ridden patients can easily consume the liquid disposed in the bottle body 10 without assistance.

With this invention thus explained, it is apparent that numerous modifications and variations can be made without departing from the scope and spirit of this invention. It is therefore intended that the invention be limited only as indicated in the appended claims.

I claim:

1. A drinking bottle comprising:

a bottle body defining a liquid-accommodating space therein, and having an upper end opening for access into said liquid-accommodating space, and an externally threaded upper end portion;

an annular cap having an internally threaded lower skirt portion that engages threadably said externally threaded upper end portion of said bottle body, and a horizontal annular plate which has an outer periphery that is formed integrally with an upper end of said internally threaded lower skirt portion, and an inner periphery which defines an eccentric hole that is offset from a center of said annular plate, said cap being formed with a vent hole; and a unitary liquid-sucking member made of a flexible material, and having a horizontal disk that is clamped between said externally threaded upper end portion of said bottle body and said annular plate of said cap and that is disposed within said internally threaded lower skirt portion of said cap in such a manner that a liquid-tight seal is established between said cap and said liquid-sucking member and between said liquid-sucking member and said bottle body, a suction tube that is formed on a top surface of said disk and that extends through said eccentric hole in said cap, and a through hole that extends through said disk and said suction tube and that is in fluid communication with said upper end opening in said bottle body, said suction tube having a distal outer end portion that is provided with a first liquid-controlling valve so as to be adapted to permit outflow of liquid from said outer end portion when said outer end portion is sucked and so as to prevent outflow of the liquid from said outer end portion when no suction force is applied to said outer end portion, said suction tube having a proximate inner end portion which is formed with an a peripheral flange that projects outwardly and radially from an outer surface thereof adjacent to said disk so as to define a peripheral plate-retention groove that is disposed between said flange and said disk, said inner periphery of said annular plate engaging fittingly said plate-retention groove, said disk being formed with a valve hole which is in fluid communication with said vent hole in said cap and which is provided with a second liquid-controlling valve so as to close said valve hole, thereby preventing the outflow of the liquid from said bottle body therethrough when no suction force is applied to said outer end portion of said suction tube, and so as to open said valve hole, thereby permitting inflow of air into said bottle body when said outer end portion of said suction tube is sucked.

2. The drinking bottle as defined in claim 1, wherein each of said inner end portion of said suction tube, and said eccentric hole in said annular plate is oval-shaped, said eccentric hole in said annular plate having a major diameter and a minor diameter slightly smaller than those of said inner end portion of said suction tube.

3. The drinking bottle as defined in claim 2, wherein said suction tube further includes a plurality of densely located peripheral rings formed on said outer surface thereof proximate to said outer end portion.

4. The drinking bottle as defined in claim 1, wherein said suction tube has an upper end surface, said first liquid-controlling valve including two upper cross-shaped slit units which are formed in said upper end surface of said suction tube.

5. The drinking bottle as defined in claim 1, wherein said second liquid-controlling valve includes a hollow projection which projects downward from said disk, and a lower slit unit which is formed in said projection and which is in fluid communication with said vent hole in said cap and said liquid-accommodating space in said bottle body.

* * * * *